US005674111A

United States Patent [19]

Harada et al.

[11] Patent Number: 5,674,111

[45] Date of Patent: Oct. 7, 1997

[54] METHOD OF PROCESSING A WORKPIECE

[75] Inventors: Katsuhiko Harada, Tokyo; Michio Araki, Hatano, both of Japan

[73] Assignee: Fuji Oozx Inc., Kanagawa-Ken, Japan

[21] Appl. No.: 409,791

[22] Filed: Mar. 23, 1995

[30] Foreign Application Priority Data

Dec. 5, 1994 [JP] Japan ..... 6-300715

[51] Int. Cl.[6] ..... B24B 1/00

[52] U.S. Cl. ..... 451/49; 29/888.4; 29/557; 29/559; 451/55

[58] Field of Search ..... 29/888.451, 888.4, 29/557, 559, DIG. 19; 83/17, 175, 176; 451/49, 55, 69, 70, 242

[56] References Cited

U.S. PATENT DOCUMENTS

| | | | |
|---|---|---|---|
| 1,938,764 | 12/1933 | Haas et al. . | |
| 2,110,931 | 3/1938 | Dyer et al. . | |
| 2,151,528 | 3/1939 | Preston . | |
| 4,086,832 | 5/1978 | Korytko | 83/17 X |
| 4,841,682 | 6/1989 | Waelti | 451/49 |
| 5,199,222 | 4/1993 | Leroux et al. . | |
| 5,319,916 | 6/1994 | Ritt et al. | 451/49 |
| 5,551,908 | 9/1996 | Harada | 451/49 X |

FOREIGN PATENT DOCUMENTS

| | | |
|---|---|---|
| 979744 | 5/1951 | France . |

*Primary Examiner*—Timothy V. Eley
*Attorney, Agent, or Firm*—Brinks Hofer Gilson & Lione

[57] ABSTRACT

A workpiece is processed to manufacture a poppet valve comprising a larger diameter head and a stem. First, the stem is ground to correct bending and warping and to remove black skin formed by a mold releasing agent, and, then the stem of the workpiece is cut, thereby preventing variation of the total length and wear of support rollers.

1 Claim, 3 Drawing Sheets

METHOD OF PROCESSING A WORKPIECE

BACKGROUND OF THE INVENTION

The present invention relates to a method of processing a workpiece to make a poppet valve such as an engine valve used in an internal combustion engine.

Material is molded by forging to make a workpiece which comprises a larger diameter head and a stem, and a poppet valve such as an engine valve is manufactured through various mechanical processing steps, which include cutting the end of the stem; grinding the outer circumferential surface of the stem; chamfering the end of the stem; cutting a cotter groove; and grinding a head. In a conventional method, the end of the stem is cut to define the total length of the forged workpiece, and then, the outer circumferential surface of the stem is ground.

In a conventional centerless grinder, when the stem of the workpiece is ground, the range for grinding must be set from the end of the workpiece, and the total length of the workpiece must be set in advance.

In such a centerless grinder, the rotary shafts of the rotating grinding and adjusting wheels are not in parallel, so that thrust force is applied to the workpiece in grinding in a direction of retracting direction, while the outer circumferential surface of the stem is ground such that the head is projected between the grinding and adjusting wheels, so that the end of the workpiece is engaged with a stopper between the grinding and adjusting wheels and is thus positioned. The ground range is determined between the engaged end and the front end of the grinding wheel.

When the length of the stem is different as forged material (at largest about 5 cm is variable in the total length of 10 cm), if the ground range is determined from the engaged end, the distance is variable between the head and the ground portion. So, prior to grinding, the stem, must be cut to determine the total length of the workpiece.

In the foregoing method as above, forged material is rotatably supported by a plurality of support rollers, and the end face of the head is engaged with a loader head and positioned. By rotating and driving the support rollers, the workpiece itself is rotated, and the stem of the workpiece is cut by a rotating grindstone. But, black skin of the forged material is stuck on the outer circumferential surface of the support roller, thereby causing unsmooth rotation of the support rollers or workpiece, and increasing wear of the outer circumferential surface of the support roller. The black skin is formed by a mold releasing agent which is burnt on the material during hot forging.

The stem which has bending or warping is supported by the support roller, and a little deviation occurs in the total length, thereby decreasing accuracy in the ground range when the stem is ground.

SUMMARY OF THE INVENTION

In view of the foregoing disadvantages involved in the prior art, according to the present invention, it is an object to provide a method of processing a workpiece to increase accuracy in size of the workpiece; to decrease wear of a support roller when a stem of the workpiece is cut; and to assure smooth rotation of the support roller and the workpiece.

To achieve the object, according to the present invention, there is provided a method of processing a workpiece which comprises a larger diameter head and a stem, the method comprising grinding the outer circumferential surface of the stem, followed by cutting the stem at a certain distance from the end of the head.

According to the present invention, the stem of the forged workpiece is ground first to correct bending or warping, and black skin formed in forging is removed. Then, the workpiece is cut at a certain distance from the end of the head, thereby preventing sticking of the black skin to the support roller when the stem is cut, and causing no malfunction owing to bending of the stem in the total length of the workpiece.

BRIEF DESCRIPTION OF THE DRAWINGS

The features and advantages of the present invention will become more apparent on the basis of the following description with respect to accompanying drawings wherein.

DETAILED DESCRIPTION OF PREFERRED EMBODIMENT

Figure 1:
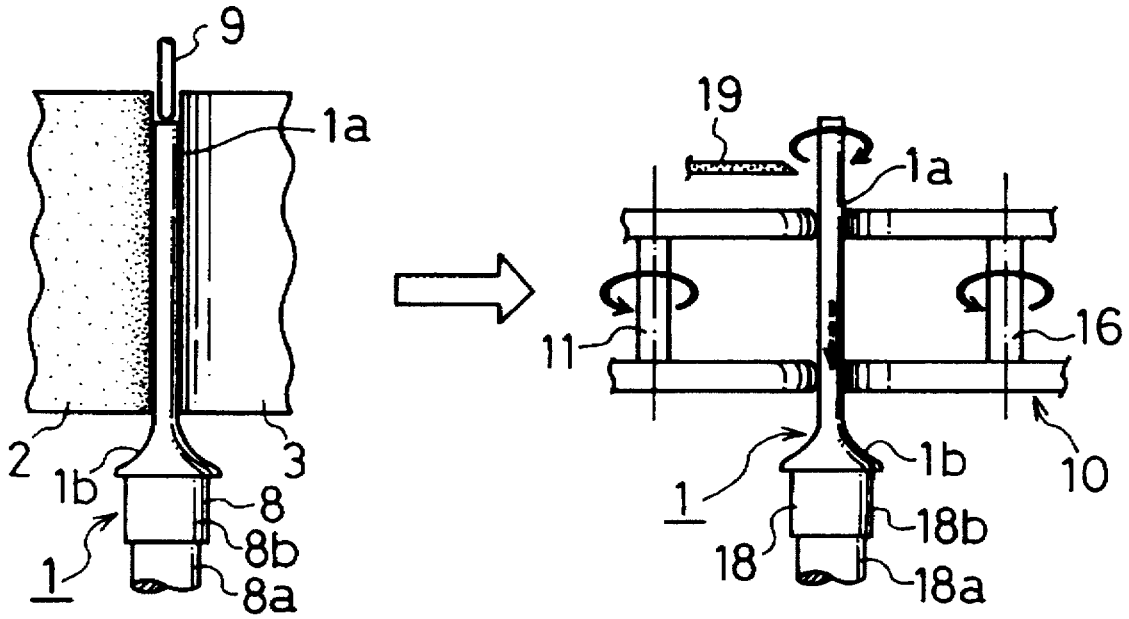
FIG. 1 is a view which shows one embodiment of a method according to the present invention.
Figure 2:
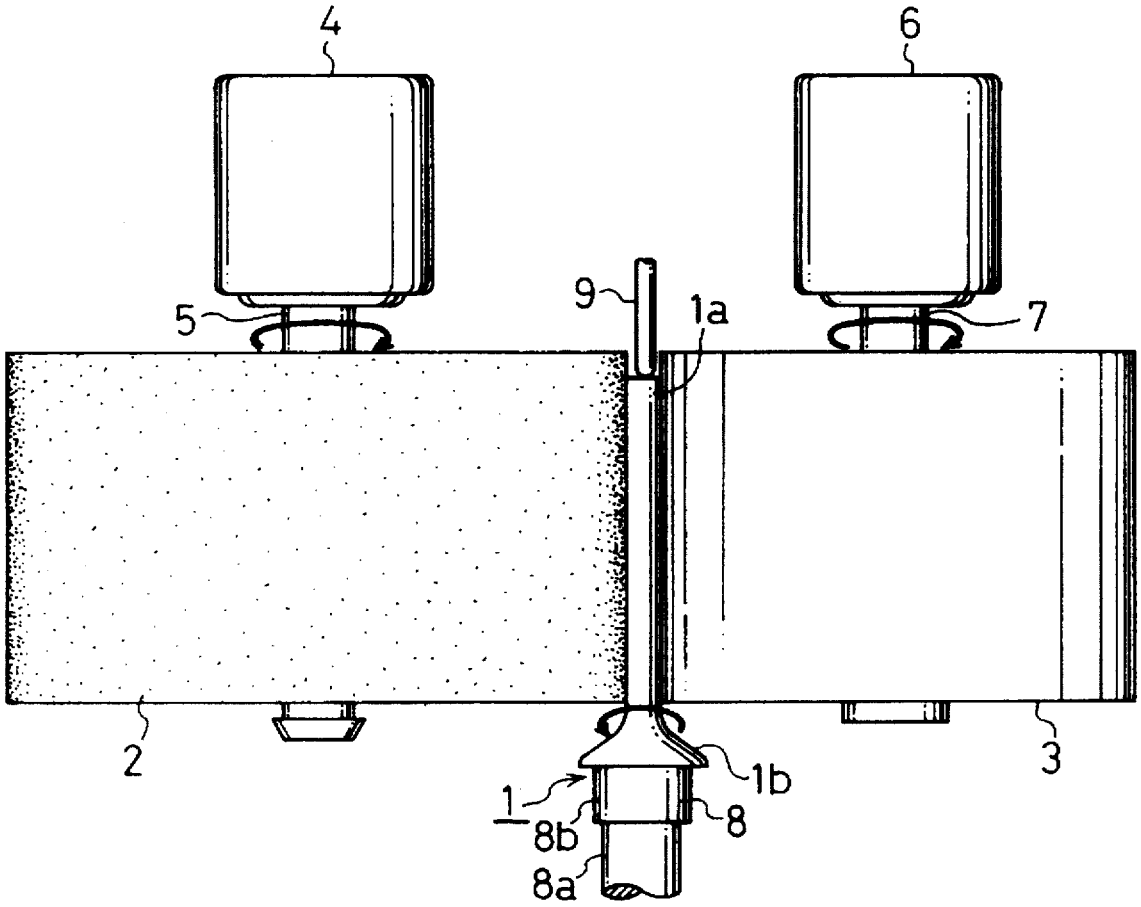
FIG. 2 is a top plan view of a main portion of a centerless grinder for grinding a workpiece.

In a workpiece 1 which is forged by hot squeezing to make an engine valve, a stem 1*a* is put between grinding and adjusting wheels 2 and 3 of a centerless grinder as shown in a left portion of FIG. 1 and FIG. 2. By opening a space between the grinding and adjusting wheels 2 and 3, the workpiece 1 to be processed is put on a workpiece support plate, and the space is reduced, so that the stem 1*a* of the workpiece 1 is put between the grinding and adjusting wheels 2 and 3. The grinding wheel 2 is rotated at high speed by a first motor 4 via a first rotary shaft 5. The adjusting wheel 3 is rotated by a second motor 6 via a second rotary shaft 7 in the same direction as that of the grinding wheel 2 at speed lower than that of the grinding wheel 2, so that the workpiece 1 is rotated in a direction opposite to the grinding wheel 2 on the workpiece support plate, thereby grinding the outer circumferential surface of the stem 1*a*.

A head 1*b* which has a diameter larger than the stem 1*a* is provided at one end of the stem 1*a* of the workpiece 1 and is projected forward on the grinding and adjusting wheels 2 and 3 as shown in FIGS. 1 and 2. The end face of the head 1*b* is engaged by a loader head 8 as a stopper, and the rear end face of the stem 1*a* is engaged by a pusher 9 which is inserted between the grinding and adjusting wheels 2 and 3. The loader head 8 comprises a support shaft 8*a* and a bottom cylindrical head 8*b* which is connected to the end of the shaft 8*a* by a spherical bearing(not shown) rotatably and somewhat shakably.

The outer circumferential surface of the stem 1*a* is thus ground. Even if there is variation in the length of the stem 1*a* or even if a rearward thrust force (toward pusher 9) is exerted on the workpiece 1, the workpiece 1 will always be ground along a section of the stem 1*a* that begins at a predetermined distance from the end face of the head 1*b*.

In a conventional centerless grinder, the rotary shaft 7 of the adjusting wheel 3 is inclined upward in a front direction with respect to the rotary shaft 5 of the grinding wheel 2, so that rearward thrust force is applied to the workpiece 1. Therefore, forward pressing force to the workpiece 1 by the pusher 9 must be larger than the thrust force. But, the rotary shaft 7 is slightly inclined downward in a forward direction, so that forward thrust force is applied to the workpiece, which is pressed towards the loader head 8 by the thrust force, so that pressing force to the workpiece 1 by the pusher 9 may be relatively small.

Grinding the stem 1*a* causes no bending or warping of the stem 1*a* of the workpiece 1 after processing of hot squeeze forging, and removes black skin which is formed from a mold releasing agent.

Figure 3:
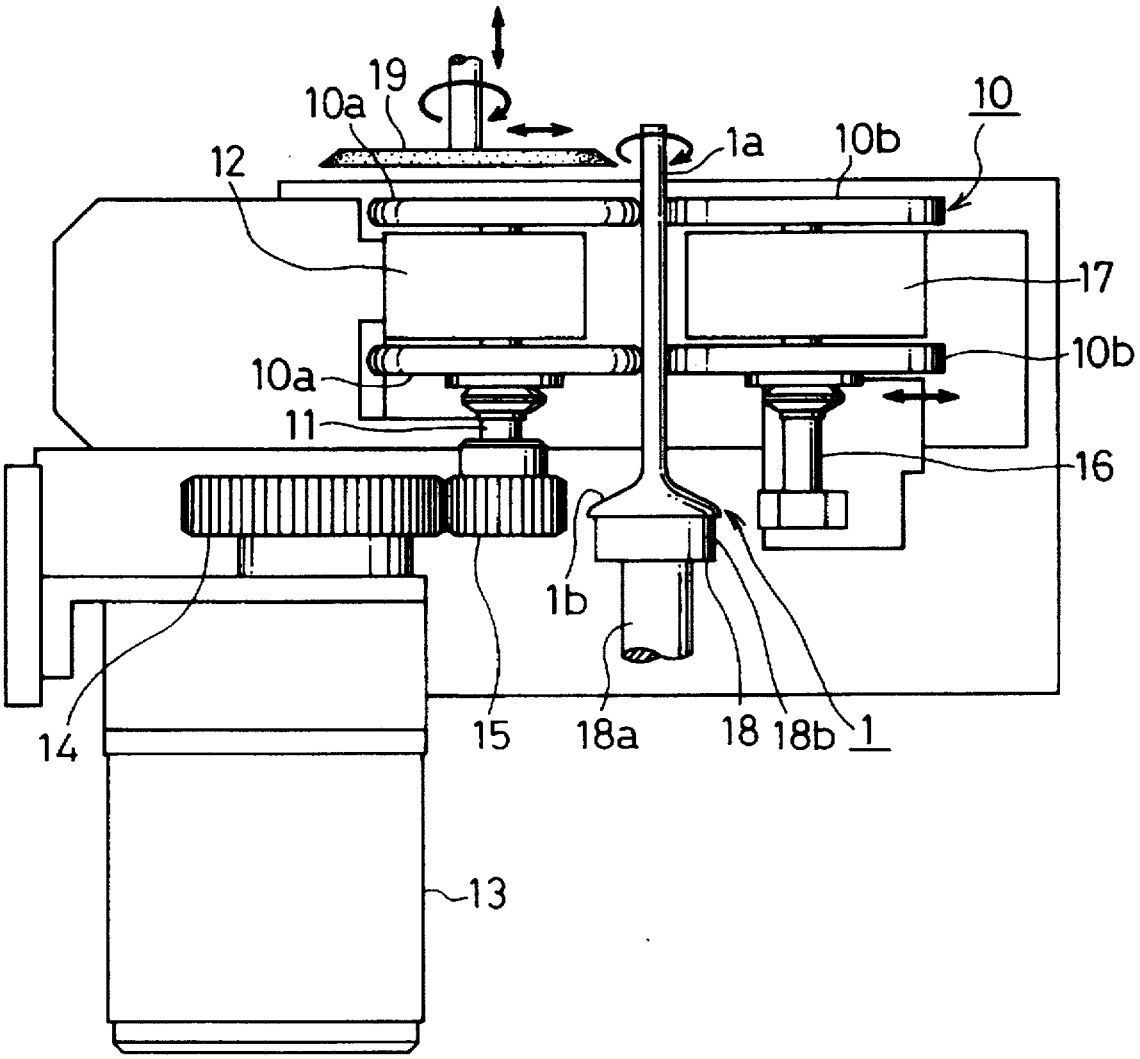
FIG. 3 is a top plan view of a main portion of a cutting device for cutting a stem of the workpiece.

Then, the workpiece 1 in which the outer circumferential surface of the stem 1*a* is ground and transferred to a cutting device in FIGS. 1 and 3. In the cutting device, the workpiece 1 is placed between two driving rollers 10*a*, 10*b* and two driven rollers 10*b*, 10*b* as support rollers 10. A driving shaft 11 through the two driving rollers 10*a*, 10*a* is rotatably supported by an intermediate bearing, and is driven by a motor 13 via driving and driven gears 14 and 15. The two driven rollers 10*b*, 10*b* are arranged against the driving rollers 10*a*, 10*a*, and a rotary shaft 11 is rotatably supported by an intermediate bearing 12. After the driven roller 10*b* is drawn apart from the driving roller 10*a*, the workpiece 1 is placed therebetween by drawing the driven roller 10*b* towards the driving roller 10*a* on a workpiece support plate (not shown).

The axis of the driving shaft 11 of the driving roller 10*a* is horizontal, while the axis of the rotary shaft 16 of the driven roller 10*b* is slightly inclined upward in a front direction. (The lower parts in FIGS. 1 and 3 are front.) The end of the head 1*b* of the workpiece 1 is engaged on a loader head 18 having a shaft 18*a* and a head 18*b*, similar to the loader head 8 in FIG. 2. By forward thrust force which is caused by slightly inclining the rotary shaft upward in a front direction, the workpiece 1 is pushed against the loader head 18 and is thus positioned correctly, in which a cutting grinding wheel 19 which rotates at high speed 19 is allowed to come near the stem of the workpiece 1, which is cut. Therefore, the workpiece 1 is thrusted towards the loader head 18, so that the total length of the engine valve which is distance from the head to the cut position is always determined accurately.

The foregoings merely relates to an embodiment of the present invention. Various changes and modifications may be made by person skilled in the art without departing from the scope of claims wherein:

What is claimed is:

1. A method of processing a poppet valve which comprises a stem and a head, said head having an end face and a diameter that is larger than the stem diameter, wherein the method comprising the steps of:

engaging the end face of the head with a first loader head to position the poppet valve;

grinding an outer circumferential surface of the stem;

supporting the ground outer circumferential surface of the stem by a plurality of support rollers;

engaging the end face of the head with a second loader head to position the poppet valve; and cutting the stem at a predetermined distance from the end face of the head while the poppet valve is supported by said plurality of support rollers on said ground outer circumferential surface of said stem.

* * * * *